US005154073A

United States Patent [19]

Huang

[11] Patent Number: 5,154,073

[45] Date of Patent: Oct. 13, 1992

[54] PLATE BLOCK KEY RING

[76] Inventor: Yu-Hwei Huang, 1/F, No. 5, Alley 2, Lane 85, Min Tsu Road, Lu Chou Hsiang, Taipei Hsien, Taiwan

[21] Appl. No.: 750,247

[22] Filed: Aug. 27, 1991

[51] Int. Cl.[5] ..... A44B 15/00

[52] U.S. Cl. ..... 70/456 R; 206/37.5; 70/459

[58] Field of Search ..... 70/456 R, 456 B, 457, 70/458, 459; 24/3 K; 206/38.1, 37.8, 37.5, 37.6

[56] References Cited

U.S. PATENT DOCUMENTS

| | | | |
|---|---|---|---|
| 3,257,696 | 6/1966 | Miller et al. | 70/456 R |
| 3,608,343 | 9/1971 | Kimel | 70/456 B |
| 4,193,278 | 3/1980 | Martinez | 70/459 |
| 4,584,858 | 4/1986 | Wolter | 70/459 |
| 4,592,219 | 6/1986 | Richter | 70/456 R |
| 4,821,543 | 4/1989 | Scungio | 24/3 K |
| 5,050,414 | 9/1991 | Huang | 70/456 R |

FOREIGN PATENT DOCUMENTS

| | | | |
|---|---|---|---|
| 720198 | 10/1965 | Canada | 70/456 R |
| 2572262 | 5/1986 | France | 70/456 R |

*Primary Examiner*—Renee S. Luebke
*Assistant Examiner*—D. Boucher
*Attorney, Agent, or Firm*—Bacon & Thomas

[57] ABSTRACT

The present invention relates to a plate block key ring, wherein several plate blocks are combined with a swivel shaft, so as to be enable the blocks to rotate. These plate blocks have peripheral rails to form key ring outlets that allow keys to be readily attached to and detached from the ring. A locating spring device is disposed between the plate blocks which can define certain positions of the plate blocks after they rotate to relative angular positions.

8 Claims, 4 Drawing Sheets

PLATE BLOCK KEY RING

BACKGROUND OF THE INVENTION

The present invention pertains to a "plate block key ring", particularly a kind of novel plate block for fast taking off and putting on of keys, which can prevent the key ring from loosening.

The invention has a main object to provide a novel plate block key ring, wherein the delicate arrangement and combination of the plate blocks form notches adapted for taking off keys, so that the keys can be readily detached or attached.

Another object of the invention is to provide a plate block key ring having a readily rotatable and reliable swivel shaft and locator arrangement. Another object of the invention is to provide a plate block key ring wherein the embedded swivel shaft and location arrangement do not influence the appearance of the plate blocks, so that the surfaces of the plate blocks can have different colors on them so as to be aesthetically appealing.

SUMMARY OF THE INVENTION

Therefore, according to the plate block key ring of the present invention, it includes primarily therein: left, middle, and right, i.e., three plate blocks, these structures are characterized by a swivel shaft for connecting these blocks, and a locating device embedded within the plate blocks. Through the accesses formed by the plate blocks rotating in different directions, the key ring can offer fast attaching and detaching of keys, as well as ascertainable locating of the blocks in various positions.

DETAILED DESCRIPTION OF THE PREFERRED EMBODIMENTS

Figure 1:
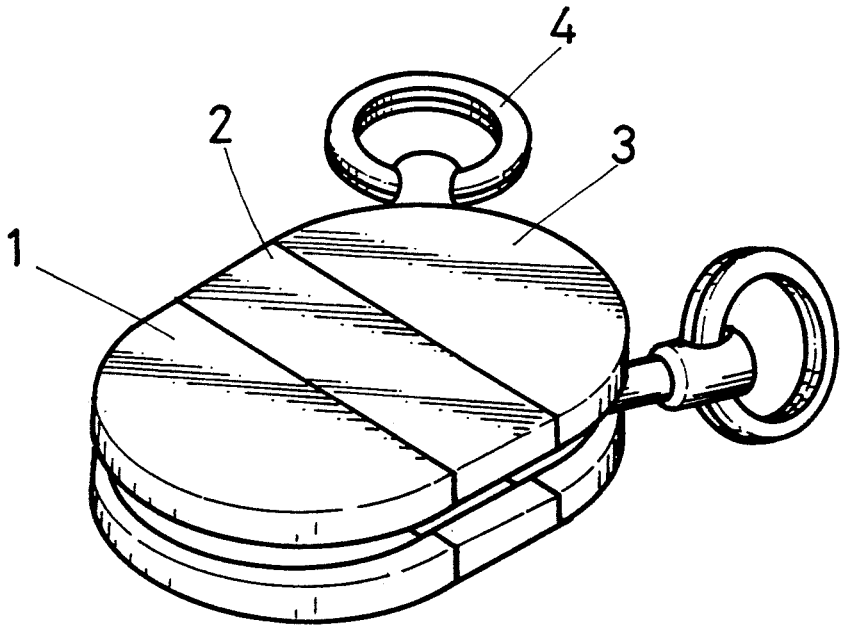
FIG. 1 is a perspective view of the present invention.

Referring to the first embodiment of the present invention, the plate block key ring includes a left plate block 1, a middle plate block 2, a right plate block 3 and a plurality of key ringlets 4. These three plate blocks are combined with a swivel shaft 5 embedded among the left, middle and right plate blocks, and are adapted to rotate about shaft 5. There are steel balls 7 which are biased by the two ends of a locating spring 6 disposed in the middle plate block 2 such that balls 7 are biased into engagement with respective recesses 8 in the left and right plate blocks. In this manner, the plate blocks can be moved relative to each other to desired positions as will be discussed more fully below.

Figure 2:
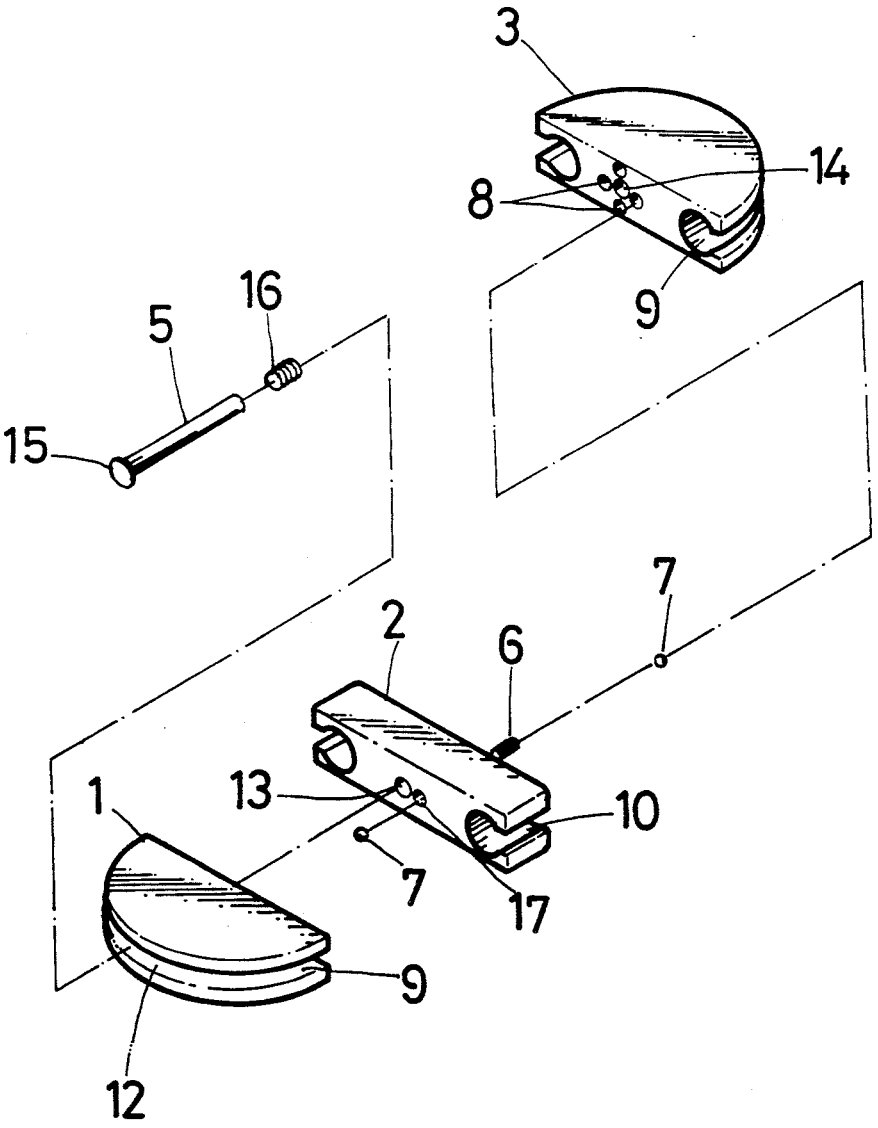
FIG. 2 is an exploded perspective view of the present invention.

FIG. 2 is an exploded perspective view of the present invention, wherein the left plate block 1 and right plate block 3 assume semicircular shapes. A rail 9 is provided on the periphery of each of the semicircular plate blocks (only at the edge of the circular arc). On both sides of the middle plated block are rails 10, such that when the plate blocks 1, 2 and 3 are aligned (as shown in FIG. 1), rails 9 and 10 form a continuous passageway, that allows key ringlets 4 to slide freely in one of the rails. Rails 9 and 10 assume a "Ω" shape (i.e. substantially circular in cross-section) that allows ball shaped heads 11 of the key ringlets 4 to be held therein and to slide freely without falling off; the rails can also take a "⊏⊐" shape (i.e. substantially box-shaped in cross-section). The left plate block 1 is provided with an axial through hole 12, the middle plate block 2 is also provided with an axial hole 13, and the right plate block 3 with an axial hole or bore 14. These three plate blocks are combined with the swivel shaft 5 extending in these axial holes. Swivel shaft 5 has on one end thereof an enlarged head 15 formed integrally therewith against which a control spring 16 is engaged which aids these three plate blocks to rotate more easily (i.e., slightly pull away the left and right plate blocks sidewards, to reduce the friction forces therebetween).

Figure 4:
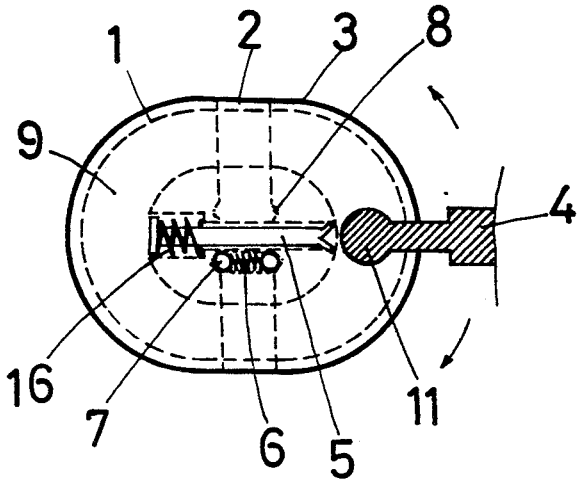
FIG. 4 is a top view of the prevent invention.

When all three plate blocks are joined, the other end of the swivel shaft 5 is fixed to one of the left and right plate blocks, such as by riveting. Adjacent axial hole 13 of the middle plate block 2 is a through hole 17 which houses spring 6 that biases steel balls 7 on each end. The distance between axial hole 13 and through hole 17 from center to center is taken as a radius, and the axial holes 12, 14 are taken as the center, and on the circles drawn herewith, there are provided two or more locating recesses 8 on the end faces of the left and right plate blocks 1, 3, respectively. The locating recesses 8 can determine the angle between the middle plate block 2 and right plate block 3 after rotation. The locating recesses 8 can be of semicircular or conical shape (referring also to FIG. 4).

Figure 3:
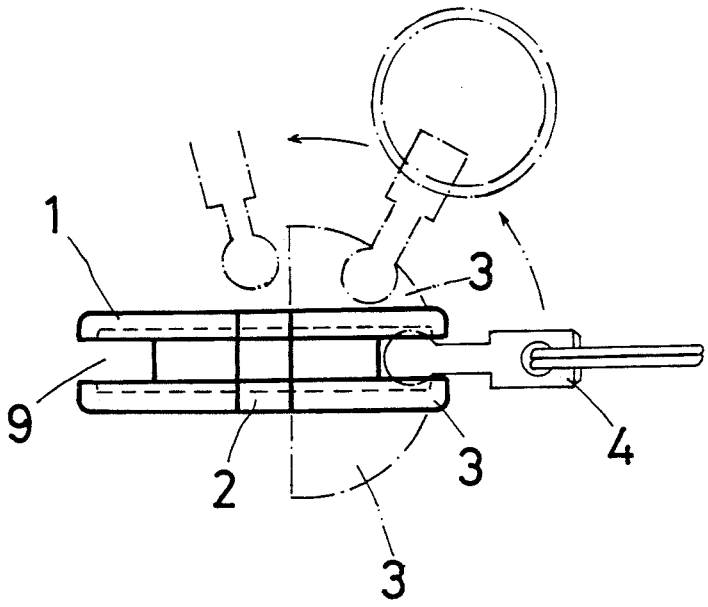
FIG. 3 is a side view of the present invention.

FIG. 3 is a side view, wherein the left, middle and right plate blocks are all rotatable to any angular position, wherein the right plate block 3 is shown rotated, in phantom, to a position 90 degrees with respect to middle plate block 2. When in this state, the key ringlets 4 originally seated on the right plated block 3 are able to slide out through the notches on the rail 9, (the right plate block 3 having two directions for sliding out).

Figure 5:
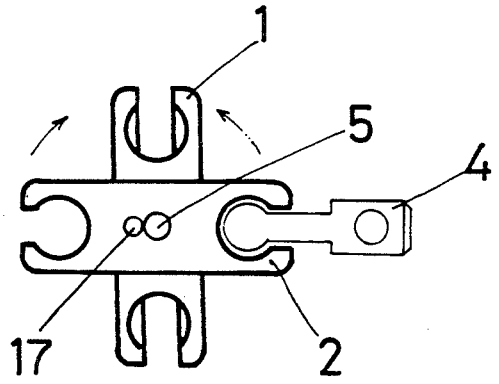
FIG. 5 is a frontal schematic drawing of the present invention.

FIG. 5 is a front schematic view of the invention, as stated above. The middle plate block 2 has along the rail 9 a plurality of notches as outlets for key ringlets 4. The number of permissible sliding out directions totals four. That is to say, the plate block key ring totally has 8 outlets for key ringlets 4 to slide out, this greatly increases the convenience and speed for taking off and attaching keys.

Figure 6:
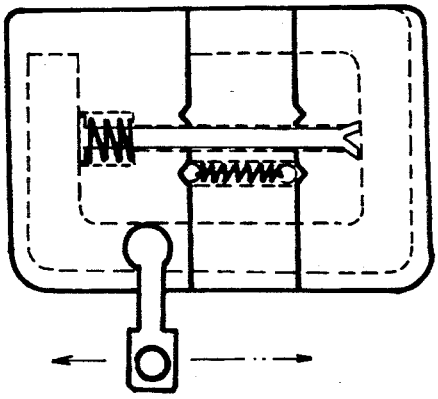
FIG. 6 is a diagram of another embodiment of the present invention.

The embodiment of FIG. 6 is similar to the above described embodiment except that the outer blocks are generally rectangular in shape. In addition, the rail extends through one end of the middle block, about the perimeter of one outer block, through the outer end of the middle block and within the only two of the three exposed sides of the other end block as clearly shown in FIG. 6.

The invention is ascertained to be useful in accordance with the above stated advantages. It is to be understood that the description stated above referring to the drawings is only directed to preferred embodiments of the present invention and various modifications or changes of the plate block key ring can be made without departing from the spirit and scope of the present invention as defined by the following claims.

I claim:

1. A plate block key ring comprising:

at least one key ringlet;

a first plate block having a first end face and a through hole which extends through said first plate block substantially perpendicular to said first end face, said first end face also having a plurality of recesses spaced about said through hole;

a second plate block having a second end face and a bore that extends into said second plate block substantially perpendicular to said second end face, said second end face also having a plurality of recesses spaced about said bore;

a third plate block interposed between said first and second plate blocks and defining third and fourth opposing end faces, said third plate block including an axial hole extending therethrough along with a through hole, offset from said axial hole, with both said axial hole and through hole extending substantially perpendicular to said third and fourth end faces, each of said first, second and third plate blocks further being formed with ring rails about predetermined portions of the periphery thereof which can be aligned to form a continuous ring rail about said plate block key ring;

a swivel shaft axially extending through said through hole in said first plate block, said axial hole in said third plate block and said bore in said second plate block to serially interconnect said plate blocks, said swivel shaft being secured at one end to said third plate block and enabling relative rotation between said plate blocks thereabout, said swivel shaft being formed with an enlarged head on an end opposite the secured end;

a control spring concentrically mounted about said swivel shaft, said control spring being interposed between a portion of said first plate block and the enlarged head of said swivel shaft within the through hole formed in said first plate block so as to bias the respective end faces of said plate blocks into engagement;

a locator spring housed within the axial hole formed in said third plate block, said locator spring having first and second ends; and first and second locator members adapted to engage the first and second ends of said locator spring respectively, each of said locator members projecting from a respective end face of said third plate block and being adapted to be received within one of the plurality of recesses formed in the end faces of said first and third block plates respectively, whereby said first, second and third plate blocks are biased into engagement by said control spring and wherein said plate blocks can be rotated relative to each other about said swivel shaft by dislodging at least one of said locating members from its respective recess to break the continuous ring rail and enable said at least one key ringlet to be attached to or detached from said key ring.

2. The plate block key ring as claimed in claim 1, wherein said first and second locator members comprise steel balls.

3. The plate block key ring as claimed in claim 1, wherein said first and second plate blocks are semi-circular in shape.

4. The plate block key ring as claimed in claim 1, wherein said first and second plate blocks are rectangular in shape.

5. The plate block key ring as claimed in claim 1, wherein said ring rails are generally circular in cross-section.

6. The plate block key ring as claimed in claim 1, wherein the ring rails are generally box-shaped in cross-section.

7. The plate block key ring as claimed in claim 1, wherein said plurality of recesses formed in both said first and second plate blocks are semi-circular shaped.

8. The plate block key ring as claimed in claim 1, wherein said plurality of recesses formed in both said first and second plate blocks are conical in shape.

* * * * *